US006920994B2

(12) United States Patent
Lin

(10) Patent No.: US 6,920,994 B2
(45) Date of Patent: Jul. 26, 2005

(54) GARBAGE STORAGE DEVICE

(76) Inventor: Tsong-Yow Lin, No. 57-1, Yung Ho Street, Yung Ho Village, Ta Tu Hsiang, Taichung Hsien (TW)

( * ) Notice: Subject to any disclaimer, the term of this patent is extended or adjusted under 35 U.S.C. 154(b) by 105 days.

(21) Appl. No.: 10/418,935

(22) Filed: Apr. 18, 2003

(65) Prior Publication Data

US 2004/0206758 A1 Oct. 21, 2004

(51) Int. Cl.[7] ..... B65D 43/26

(52) U.S. Cl. ..... 220/264; 220/908; 220/263; 220/830; 16/85; 49/273

(58) Field of Search ..... 220/263, 264, 220/908, 830; 16/85; 4/246.1, 246.3; 74/512; 49/273, 274

(56) References Cited

U.S. PATENT DOCUMENTS

| | | | | | |
|---|---|---|---|---|---|
| 966,145 | A | | 8/1910 | Wilder | |
| 1,012,346 | A | | 12/1911 | Fraser | |
| 1,237,016 | A | | 8/1917 | Brown | |
| 1,265,148 | A | | 5/1918 | Warren | |
| 1,379,677 | A | | 5/1921 | Brunhoff | |
| 1,461,253 | A | | 7/1923 | Owen | |
| 1,489,447 | A | * | 4/1924 | Leeb | 312/23 |
| 1,507,040 | A | | 9/1924 | Ziffere | 220/263 |
| 1,515,989 | A | | 11/1924 | Banes | 220/264 X |
| 1,615,879 | A | * | 2/1927 | Leppert | 220/263 |
| 1,639,992 | A | * | 8/1927 | Geibel | 220/263 |
| 1,703,509 | A | | 2/1929 | Chandlee | |
| 1,714,332 | A | * | 5/1929 | Ullrich | 220/263 |
| 1,799,621 | A | | 4/1931 | Shaw | |
| 1,820,555 | A | | 8/1931 | Buschman | |
| 1,881,120 | A | | 10/1932 | Fessler et al. | |
| 1,891,651 | A | | 12/1932 | Padelford et al. | |
| 1,966,323 | A | | 7/1934 | Von Elm | 220/263 |
| 2,016,558 | A | | 10/1935 | Redrup | |

(Continued)

FOREIGN PATENT DOCUMENTS

| | | | | |
|---|---|---|---|---|
| DE | 4132958 A1 | | 5/1992 | 220/262 |
| DE | 20001431 U1 | | 6/2000 | 220/262 |
| JP | 2000008700 A | | 1/2000 | E05F/5/08 |
| TW | 322904 | | 12/1997 | |

*Primary Examiner*—Lee Young
*Assistant Examiner*—James Smalley
(74) *Attorney, Agent, or Firm*—Alan D.. Kamrath; Nikolai & Mersereau, P.A.

(57) ABSTRACT

A garbage storage device includes a base, a bin, a pedal, a lid, a linkage, a buffer and a guide. The bin is installed on the base. The pedal is mounted on the bin. The lid is mounted on the bin. The linkage includes a crankshaft and a rod. The crankshaft includes a shaft mounted on the base, a first crank extending from the shaft for contact with the pedal and a second crank extending from the shaft. The rod includes a middle portion, a first end extending from the middle portion into connection with the second crank and a second end extending from the middle portion into connection with the lid. The buffer includes a first end connected with the base and a second end connected with the first end of the rod. The guide is mounted on the base for guiding and ensuring smooth movement of the first end of the rod.

20 Claims, 13 Drawing Sheets

U.S. PATENT DOCUMENTS

D102,512 S 12/1936 Stallings et al.
2,071,486 A * 2/1937 Wright ..... 220/263
2,096,578 A 10/1937 Flanagan
2,106,892 A * 2/1938 Kamenstein ..... 220/263
D108,642 S 3/1938 Geisel
2,170,604 A 8/1939 Creesy et al.
D118,374 S 1/1940 Kamenstein
2,195,033 A 3/1940 Lehman
D120,270 S 4/1940 Martinez
2,216,279 A 10/1940 Packer
2,242,698 A 5/1941 Evitt
2,246,975 A 6/1941 Geibel ..... 220/264 X
2,255,972 A 9/1941 Harvard
2,308,398 A 1/1943 Stevens
2,311,835 A 2/1943 Johnson
2,325,897 A * 8/1943 Waltman ..... 220/264
D145,970 S 11/1946 Bloomfield
D147,646 S 10/1947 Footlik
D151,986 S 3/1948 Hamilton
2,475,125 A 7/1949 Brownell
2,547,089 A * 4/1951 Oberst ..... 16/66
2,563,456 A 8/1951 Brownell
2,904,210 A 9/1959 Grossman
2,907,491 A 10/1959 Gunn
2,910,206 A 10/1959 Hodgson
2,920,338 A 1/1960 Falk ..... 16/66
D187,300 S 2/1960 Tupper
D187,305 S 2/1960 Leominster
2,946,474 A * 7/1960 Knapp ..... 220/23.87
D191,546 S 10/1961 Garner
D197,007 S 12/1963 Bringhton
3,450,297 A 6/1969 Clerk
3,866,791 A 2/1975 Roper et al.
D241,499 S 9/1976 Raftery
4,081,105 A 3/1978 Dagonnet et al. ..... 220/263
D256,423 S 8/1980 Bacskay et al.
D261,720 S 11/1981 Brazis
4,361,247 A 11/1982 Williams ..... 220/88.1
4,363,417 A 12/1982 Rhoades et al.
4,445,619 A 5/1984 Kubic et al.
4,473,170 A 9/1984 Ciancimino
4,489,810 A 12/1984 Curtis
4,629,167 A * 12/1986 Kimura et al. ..... 267/226
4,785,964 A 11/1988 Miller et al. ..... 220/263
4,877,226 A 10/1989 Taylor ..... 267/196
4,913,308 A 4/1990 Culbertson ..... 220/263
4,953,744 A 9/1990 Koyama
D312,160 S 11/1990 Calvi
D319,905 S 9/1991 Hotchkiss
D321,575 S 11/1991 Corps
D322,350 S 12/1991 Craft, Jr. et al.
5,082,139 A 1/1992 Quam
D327,965 S 7/1992 Chelec
D328,510 S 8/1992 Brussing
D329,929 S 9/1992 Knoedler et al.
5,142,738 A 9/1992 Ojima ..... 16/306
5,163,574 A 11/1992 Sosan ..... 220/263
5,170,904 A 12/1992 Neuhaus ..... 220/263
D332,334 S 1/1993 Jones
D332,852 S 1/1993 Delmerico
D333,024 S 2/1993 van Buiten
D333,025 S 2/1993 Doherty
D333,897 S 3/1993 Ward
D335,561 S 5/1993 Mihyar
D335,562 S 5/1993 Evans
5,211,269 A 5/1993 Ohshima ..... 188/290
5,230,525 A 7/1993 Delmerico et al. ..... 220/263
5,237,708 A * 8/1993 Zamoyski ..... 4/246.3
5,249,693 A 10/1993 Gillispie et al. ..... 220/263
5,269,087 A 12/1993 Johnston ..... 43/4
D343,486 S 1/1994 Kimport
5,295,607 A 3/1994 Chang ..... 220/263
5,350,079 A 9/1994 Larson et al.
5,356,025 A 10/1994 Renault
D352,144 S 11/1994 Brookshire et al.
D355,060 S 1/1995 Bernstein et al.
5,382,108 A 1/1995 Ojima ..... 403/120
5,440,978 A 8/1995 O'Brien et al. ..... 220/264 X
5,474,201 A 12/1995 Liu ..... 220/23.87
D368,563 S 4/1996 Brightbill et al.
5,531,348 A 7/1996 Baker et al. ..... 220/263
D377,554 S 1/1997 Adriaansen
D381,784 S 7/1997 Keller et al.
D393,334 S 4/1998 Presnell et al.
D401,028 S 11/1998 Ahern, Jr. et al.
5,842,595 A 12/1998 Williams
5,960,983 A 10/1999 Chan
D418,957 S 1/2000 Rashid
6,010,024 A 1/2000 Wang ..... 220/23.87
6,024,238 A 2/2000 Jaros ..... 220/264
D431,700 S 10/2000 Roudebush
D431,702 S 10/2000 McKeown et al.
D435,951 S 1/2001 Yang et al.
6,178,085 B1 1/2001 Leung ..... 361/683
D439,717 S 3/2001 Konieczny
6,206,281 B1 3/2001 Leung ..... 235/61 R
D441,160 S 4/2001 Lin
D442,330 S 5/2001 Cousins
D446,375 S 8/2001 Daams
D447,304 S 8/2001 Niemeyer
D447,308 S 8/2001 Lin
D447,611 S 9/2001 Lin
D450,901 S 11/2001 Lin
D453,252 S 1/2002 Lin
D453,253 S 1/2002 Lin
6,336,252 B1 1/2002 Bando ..... 16/307
D453,600 S 2/2002 Lin
D453,870 S 2/2002 Lin
6,345,725 B1 2/2002 Lin ..... 220/263
D454,239 S 3/2002 Lin
D460,595 S 7/2002 Lin
D465,629 S 11/2002 Lin
D465,630 S 11/2002 Lin
D465,893 S 11/2002 Lin
D465,894 S 11/2002 Lin
D466,265 S 11/2002 Lin
D466,667 S 12/2002 Lin
D467,696 S 12/2002 Rashid
D468,500 S 1/2003 Lin
6,510,588 B2 1/2003 Eromaki ..... 16/308
D470,639 S 2/2003 Quan
D472,686 S 4/2003 Lin
D472,687 S 4/2003 Lin
D472,688 S 4/2003 Lin
D476,126 S 6/2003 Lin
D476,128 S 6/2003 Lin
D476,458 S 6/2003 Lin
D476,460 S 6/2003 Lin
D476,788 S 7/2003 Lin
6,626,316 B2 * 9/2003 Yang ..... 220/263
2002/0079315 A1 6/2002 Yang
2002/0092853 A1 7/2002 Wang
2003/0173369 A1 9/2003 Nikolaus et al. ..... 220/830
2003/0201265 A1 10/2003 Lin ..... 220/254.3
2003/0201267 A1 10/2003 Yang et al.
2003/0201268 A1 10/2003 Lin ..... 220/263
2004/0016756 A1 1/2004 Lin ..... 220/263

* cited by examiner

GARBAGE STORAGE DEVICE

FIELD OF INVENTION

The present invention relates to a garbage storage device including a lid and a buffer for the lid.

BACKGROUND OF INVENTION

People dispose of garbage in garbage bins. Some of the garbage stinks some time after the disposal. Therefore, some of the garbage bins are equipped with lids in order to keep the odor of such garbage therein. In some other cases, people use garbage bins equipped with lids simply to conceal garbage contained therein.

Some lids can be removed from garbage bins. However, such a lid causes a user troubles since he or she has to hold the lid during disposal of garbage or find a place to lay the lid on before disposal of garbage.

A conventional garbage storage device includes a base, a bin installed on the base, a pedal pivotally mounted on the bin and a lid pivotally mounted on the bin. A linkage is arranged between the pedal and the lid. The linkage includes a crankshaft and a rod. The crankshaft is pivotally mounted on the base. The crankshaft includes a first end in contact with the pedal and includes a second end. The rod includes a first end connected with the second end of the crankshaft and a second end connected with the lid. In specific, the second end of the crankshaft defines an aperture for receiving the first end of the rod. Thus, the pedal can be trodden in order to lift the lid through the linkage. However, closing the bin with the lid often makes a loud noise.

Taiwanese Patent Publication No. 429965 discloses conventional storage apparatus. This conventional garbage storage apparatus includes an internal bin, an external bin 1 in which the internal bin is put, a base 2 on which the external bin 1 is mounted, a lid 6 pivotally mounted on the external bin 1, a pedal 11 pivotally mounted on the base 2 and a linkage connected between the lid 6 and the pedal 11. The linkage includes a crankshaft 3, a joint 4 and a rod 5. The crankshaft 3 includes a shaft mounted on the base 2, a first crank extending transversely from the shaft for contact with the pedal 11 and a second crank extending transversely from the shaft for connection with the joint 4. The joint 4 includes a first socket in which the second end of the crankshaft 3 is fit, a second socket extending transversely from the first socket in order to receive the rod 5, a rod 41 extending transversely from the sleeve and a piston 42 attached to the rod 41. Referring to FIGS. 4~6, on the base 2 is formed a cylinder 21 for receiving the piston 42. Thus, the cylinder 21 cooperates with the piston 42 in order to work as an air buffer. The cylinder 21 defines, near its bottom, a hole 22 through which air can flow into and from the cylinder 21 slowly. However, as best shown in FIG. 6, when the crankshaft 3 is pivoted, the joint 4 is bent, thus interfering movement of the piston 42 in the cylinder 21. In practice, the piston 42 is often stuck in the cylinder 21, thus prematurely stopping the lid 6 before it closes the external bin 1. Furthermore, to accommodate the cylinder 21, the base 2 must be made thick, thus increasing its cost.

The present invention is therefore intended to obviate or at least alleviate the problems encountered in the prior art.

SUMMARY OF INVENTION

It is an objective of the present invention to provide a garbage storage device that can be moved slowly and smoothly from an open position to a closed position.

According to the present invention, a garbage storage device includes a base, a bin, a pedal, a lid, a linkage, a buffer and a guide. The bin is installed on the base. The pedal is mounted on the bin. The lid is mounted on the bin. The linkage includes a crankshaft and a rod. The crankshaft includes a shaft mounted on the base, a first crank extending from the shaft for contact with the pedal and a second crank extending from the shaft. The rod includes a middle portion, a first end extending from the middle portion into connection with the second crank and a second end extending from the middle portion into connection with the lid. The buffer includes a first end connected with the base and a second end connected with the first end of the rod. The guide is mounted on the base for guiding and ensuring smooth movement of the first end of the rod.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF PREFERRED EMBODIMENTS

Figure 1:
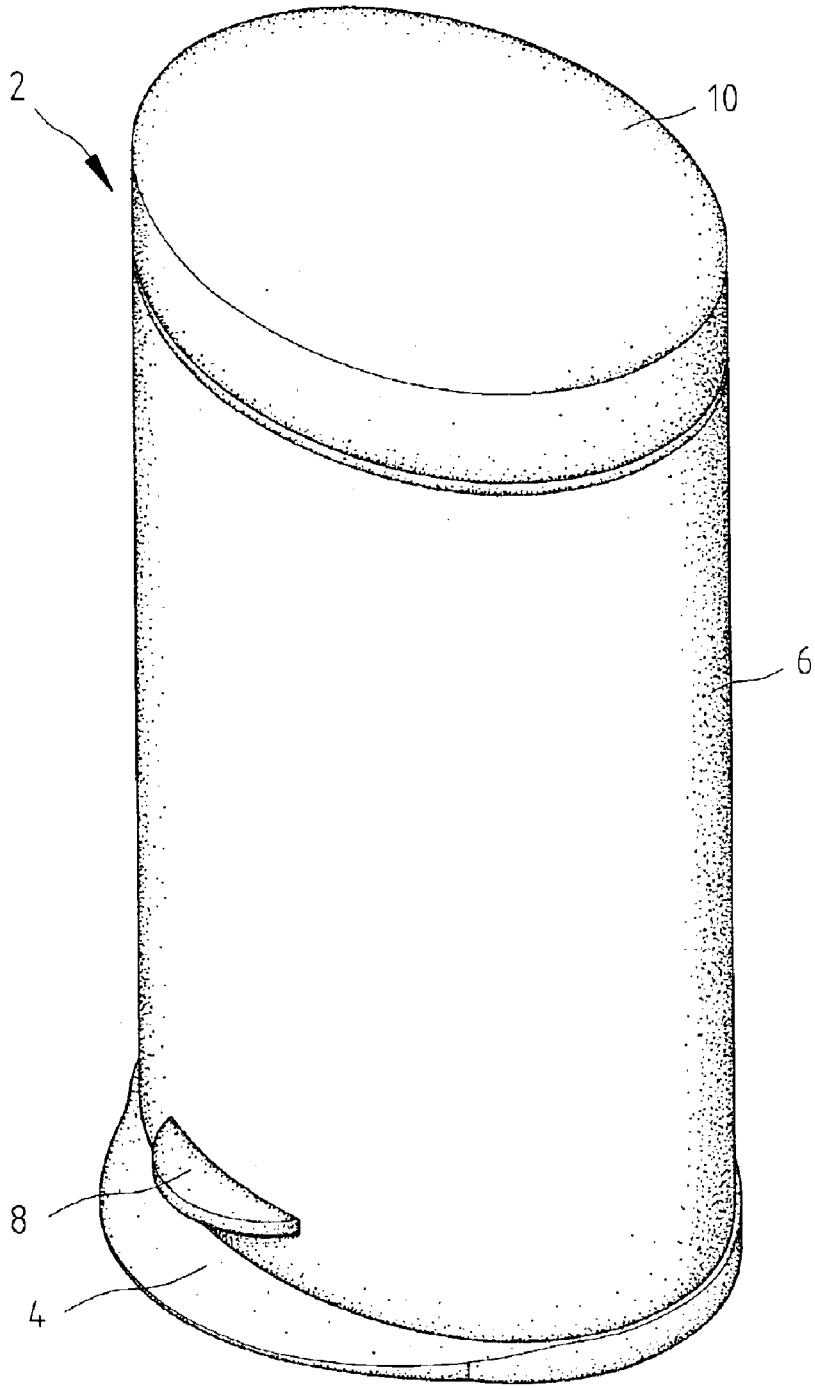
FIG. 1 is a perspective view of a garbage storage including a bin, a lid and a buffer for the lid according to a first embodiment of the present invention.

Referring to FIG. 1, a garbage storage device 2 includes a base 4, a bin 6 installed on the base 4, a pedal 8 pivotally mounted on the bin 6 and a lid 10 pivotally mounted on the bin 6.

Figure 2:
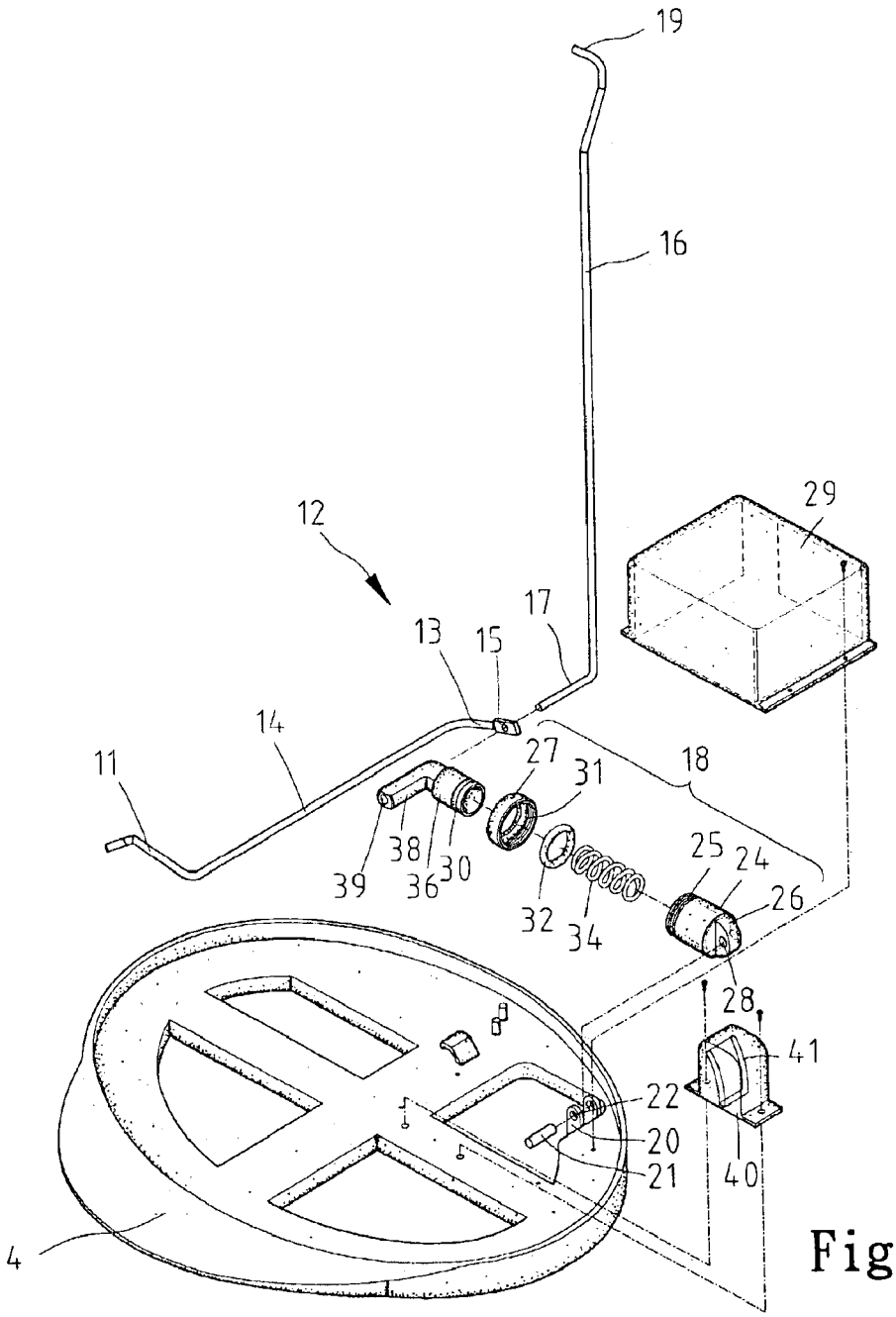
FIG. 2 is an exploded perspective view of the buffer used in the garbage storage device shown in FIG. 1.

FIG. 2 shows a linkage 12 arranged between the pedal 8 and the lid 10 shown in FIG. 1. The linkage 12 includes a crankshaft 14 and a rod 16. The crankshaft 14 includes a shaft (not numbered) mounted on the base 4, a first crank 11 extending transversely from the shaft for contact with the pedal 8 and a second crank 13 extending transversely from the shaft and defining a hole 15. The rod 16 includes a middle portion (not numbered), a first end 17 extending transversely from the middle portion into the hole 15 and a second end 19 connected with the lid 10. Thus, the pedal 8 can be trodden in order to lift the lid 10 through the linkage 12.

FIG. 2 further shows a buffer 18 according to the preferred embodiment of the present invention for use in the garbage storage device 2 shown in FIG. 1. The buffer 18 is arranged between the base 4 and the linkage 12.

For pivotal connection with the buffer 18, the base 4 includes two ears 20 each defining a hole 22.

The buffer 18 includes a first cylinder 24, a second cylinder 36 and a spring 34 including a first end inserted in the first cylinder 24 and a second end inserted in the second cylinder 36.

The first cylinder 24 includes a closed end and an open end. The first cylinder 24 includes an ear 26 formed at the closed end. The ear 26 defines a hole 28. The ear 26 is located between the ears 20. A pin 21 is inserted through the holes 22 and 28. Thus, the first cylinder 24 is pivotally mounted on the ears 20. A thread 25 is formed on the first cylinder 24 near the open end.

The second cylinder 36 includes an open end and a closed end. The open end of the second cylinder 36 is inserted in the open end of the first cylinder 24 through a ring 27. A ring 32 is received in a groove 30 extending around the second cylinder 36 near the open end. The ring 27 includes a thread 31 formed on an internal face thereof for engagement with the thread 25 formed on the first cylinder 24. Thus, the open end of the second cylinder 36 is retained in the open end of the first cylinder 24, and the spring 34 in and between the first cylinder 24 and the second cylinder 36.

A tube 38 extends transversely from the closed end of the second cylinder 36. The tube 38 defines a hole 39 through which the first end 17 of the rod 16 extends. The first end 17 of the rod 16 is inserted in the hole 39 of the tube 38. Thus, the second cylinder 36 is pivotally connected with the rod 16.

Figure 3:
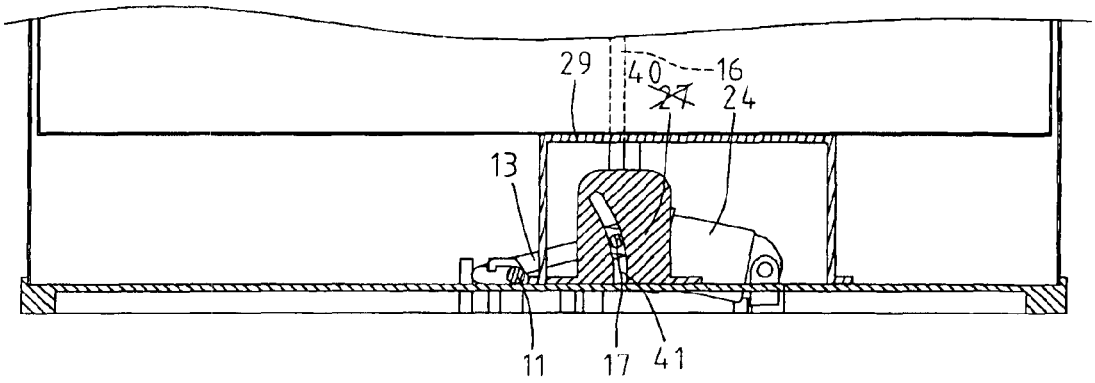
FIG. 3 is a cross-sectional view of the garbage storage device shown in FIG. 1.

A guide 40 is installed on the base 4. The guide 40 defines a slot 41 in which the first end 17 of the rod 16 is inserted. As best shown in FIG. 3, the first end 17 of the rod 16 can slide in and along the slot 41. The slot 41 extends in compliance with the curved trajectory of the first end 17 of the rod 16. Thus, smooth movement of the first end 17 of the rod 16 is ensured by the guide 40.

The buffer 18 and the guide 40 may be covered by a shelter 29 installed on the base 4.

A guide 40 is installed on the base 4. The guide 40 defines a slot 41 in which the first end 17 of the rod 16 is inserted. As best shown in FIG. 3, the first end 17 of the rod 16 can slide in and along the slot 41. The slot 41 extends in compliance with the curved trajectory of the first end 17 of the rod 16. Thus, smooth movement of the first end 17 of the rod 16 is ensured by means of the guide 40.

The buffer 18 and the guide 40 may be covered by means of a shelter 29 installed on the base 40.

Figure 4:
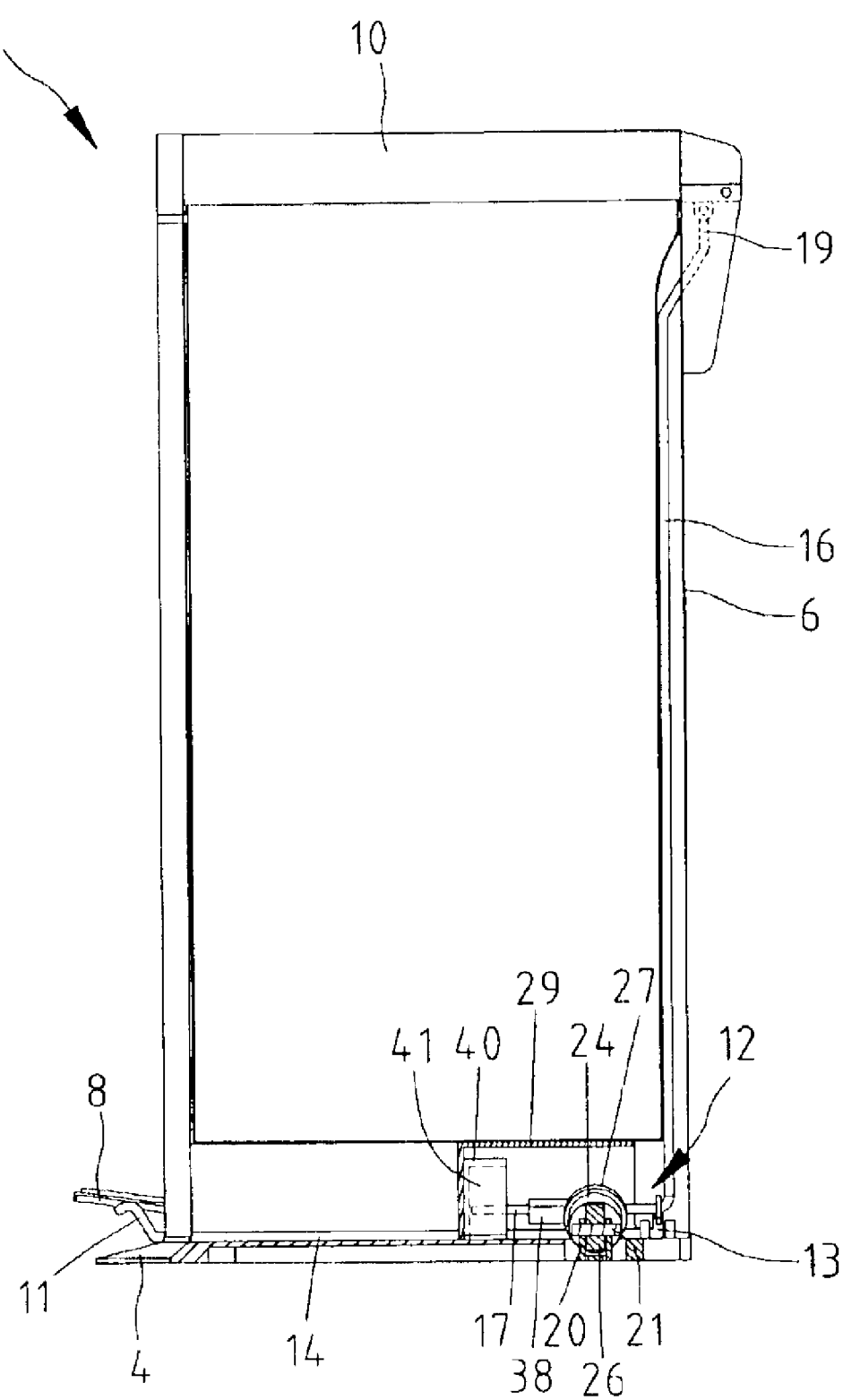
FIG. 4 is a cross-sectional view of the garbage storage device shown in FIG. 1, showing the buffer in a first position.
Figure 5:
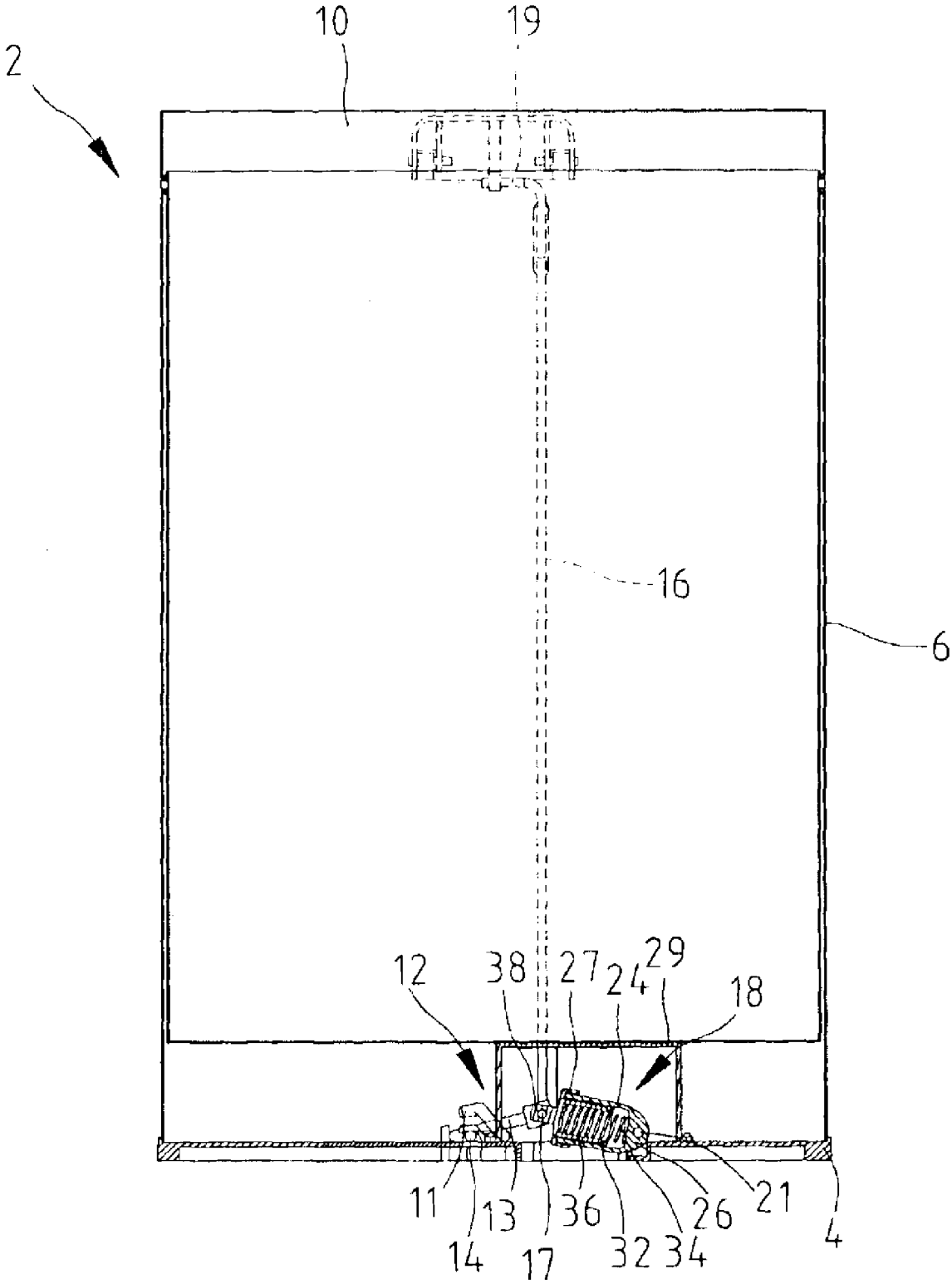
FIG. 5 is another cross-sectional view of the garbage storage device of FIG. 4.

FIGS. 4 and 5 show the garbage storage device 2 in a closed position where the buffer 18 shrinks. The spring 34 is compressed.

Figure 6:
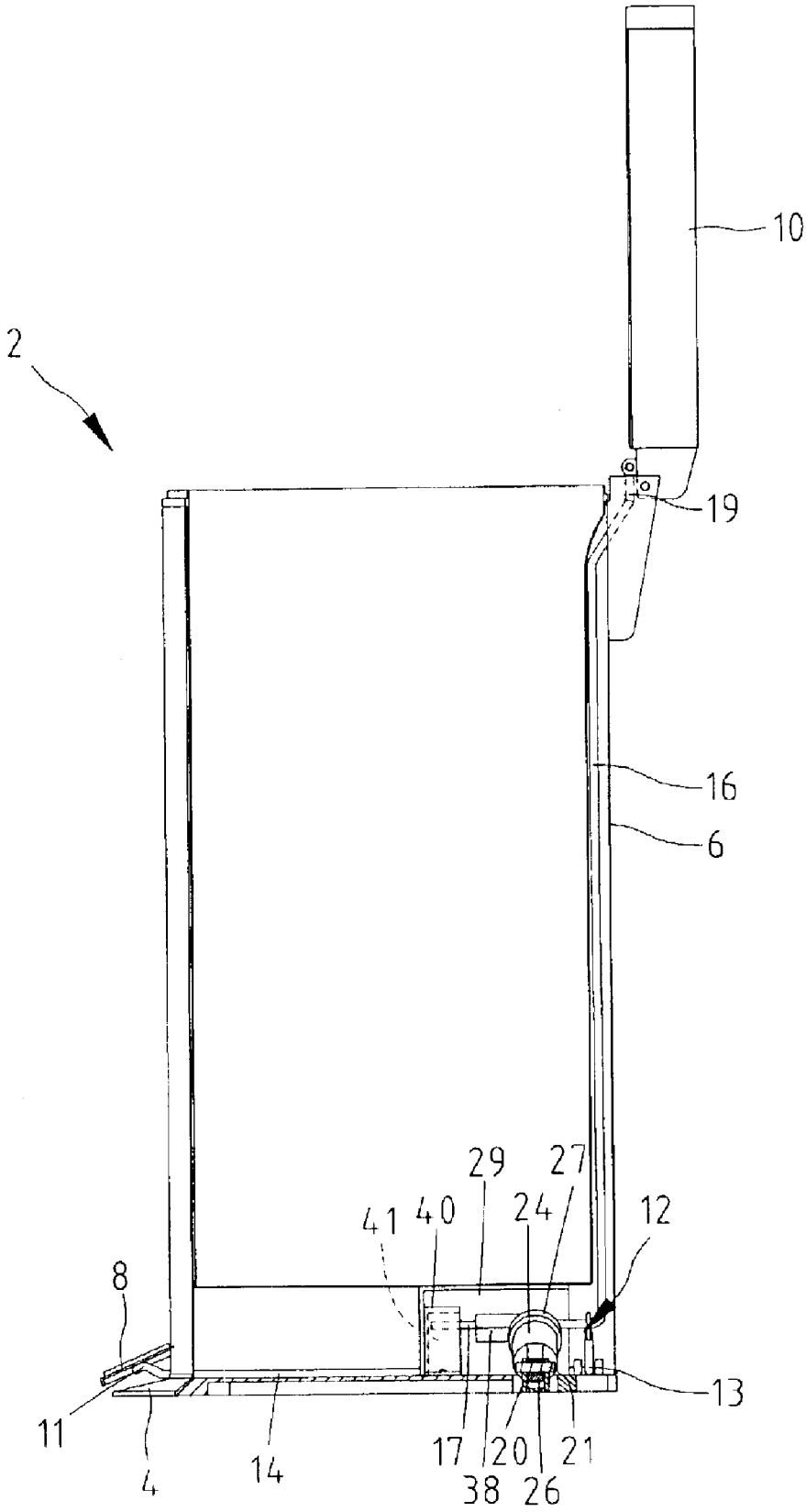
FIG. 6 is a cross-sectional view of the garbage storage device shown in FIG. 1, showing the buffer in a second position.
Figure 7:
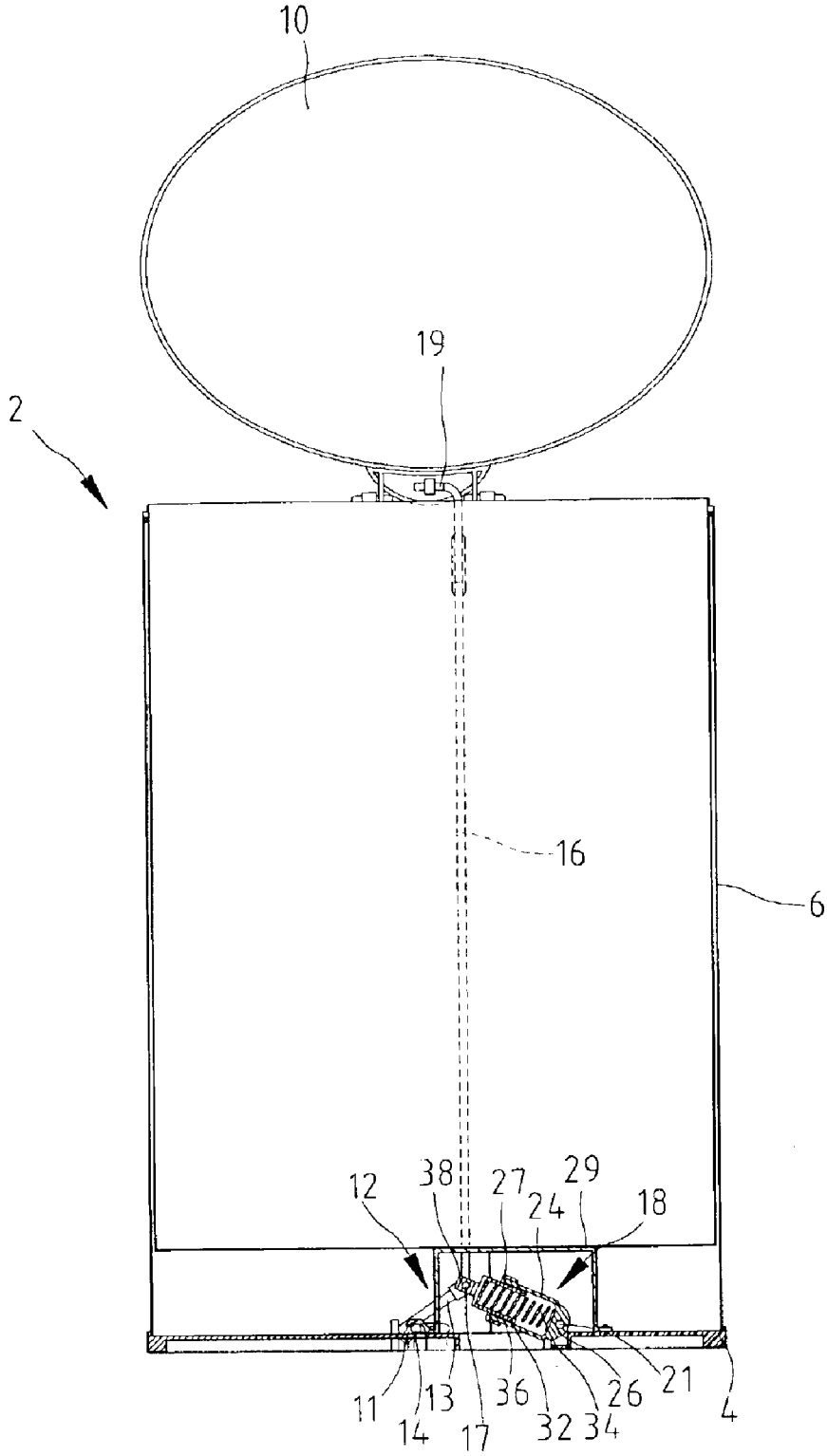
FIG. 7 is another cross-sectional view of the garbage storage device of FIG. 6.

Referring to FIGS. 6 and 7, the lid 10 is pivotally moved until the garbage storage device 2 reaches a fully open position. The buffer 18 fully extends and the spring 34 is not compressed.

Figure 8:
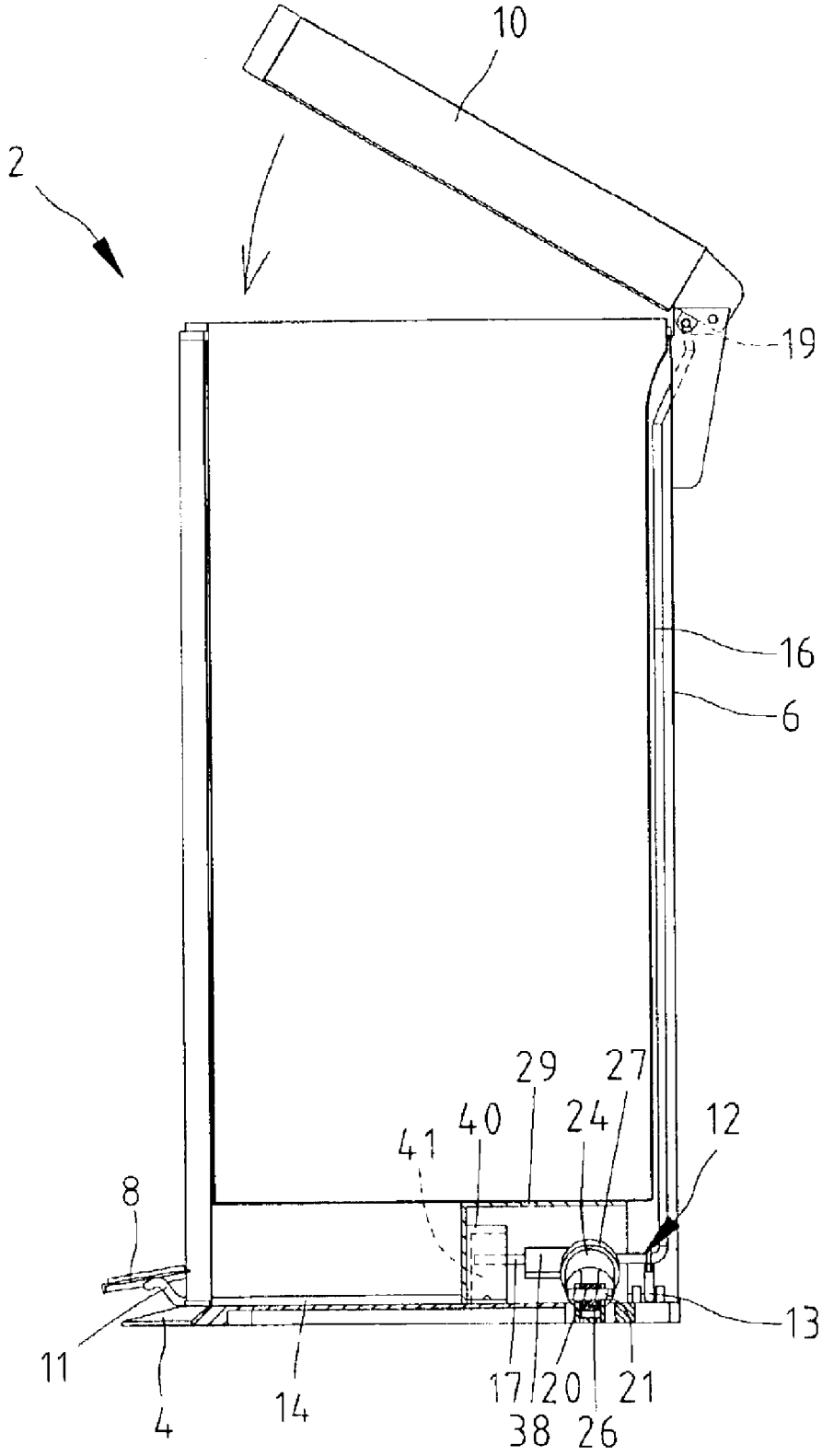
FIG. 8 is a cross-sectional view of the garbage storage device shown in FIG. 1, showing the buffer in a third position between the first and second positions.
Figure 9:
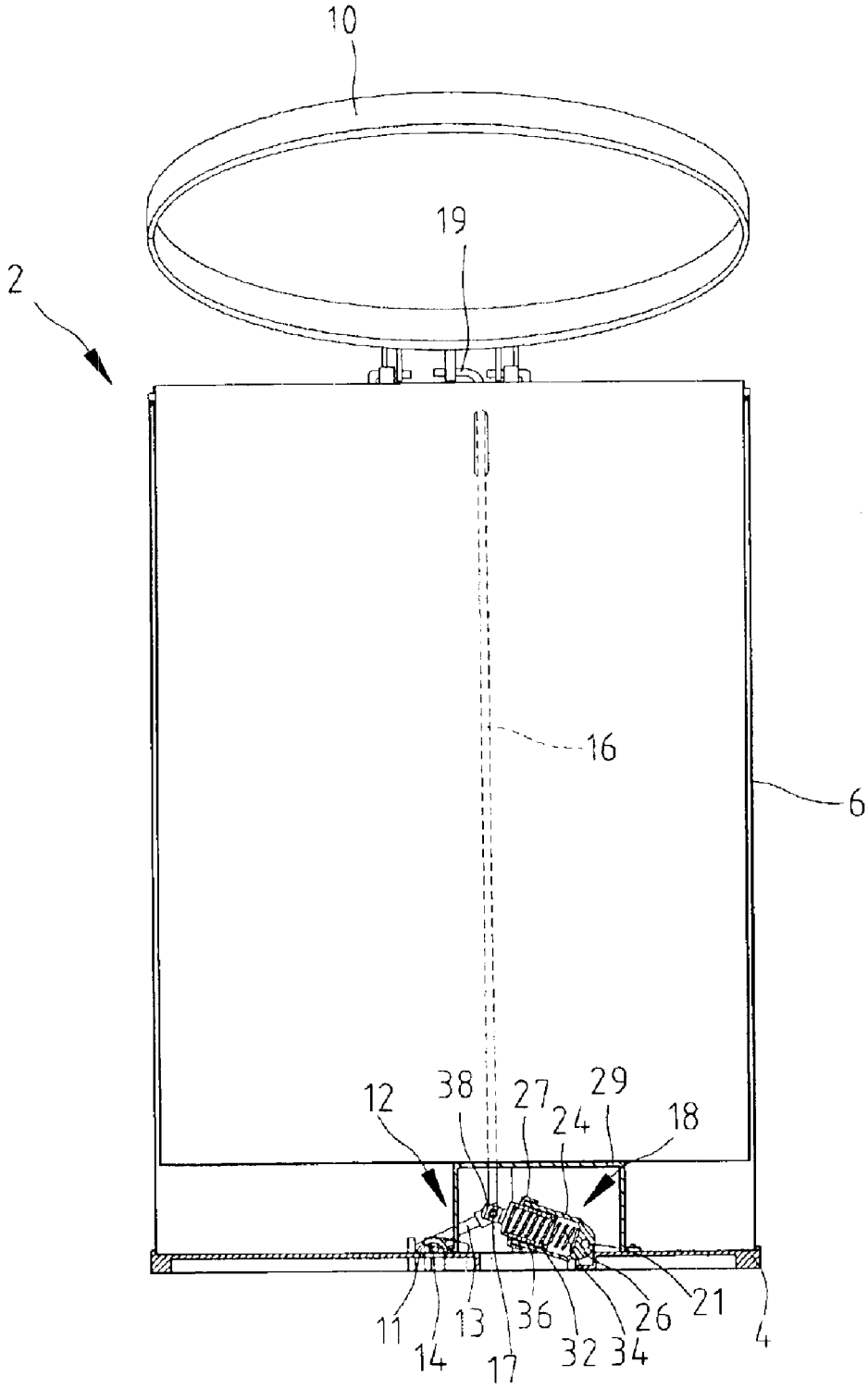
FIG. 9 is another cross-sectional view of the garbage storage device of FIG. 8.
Figure 10:
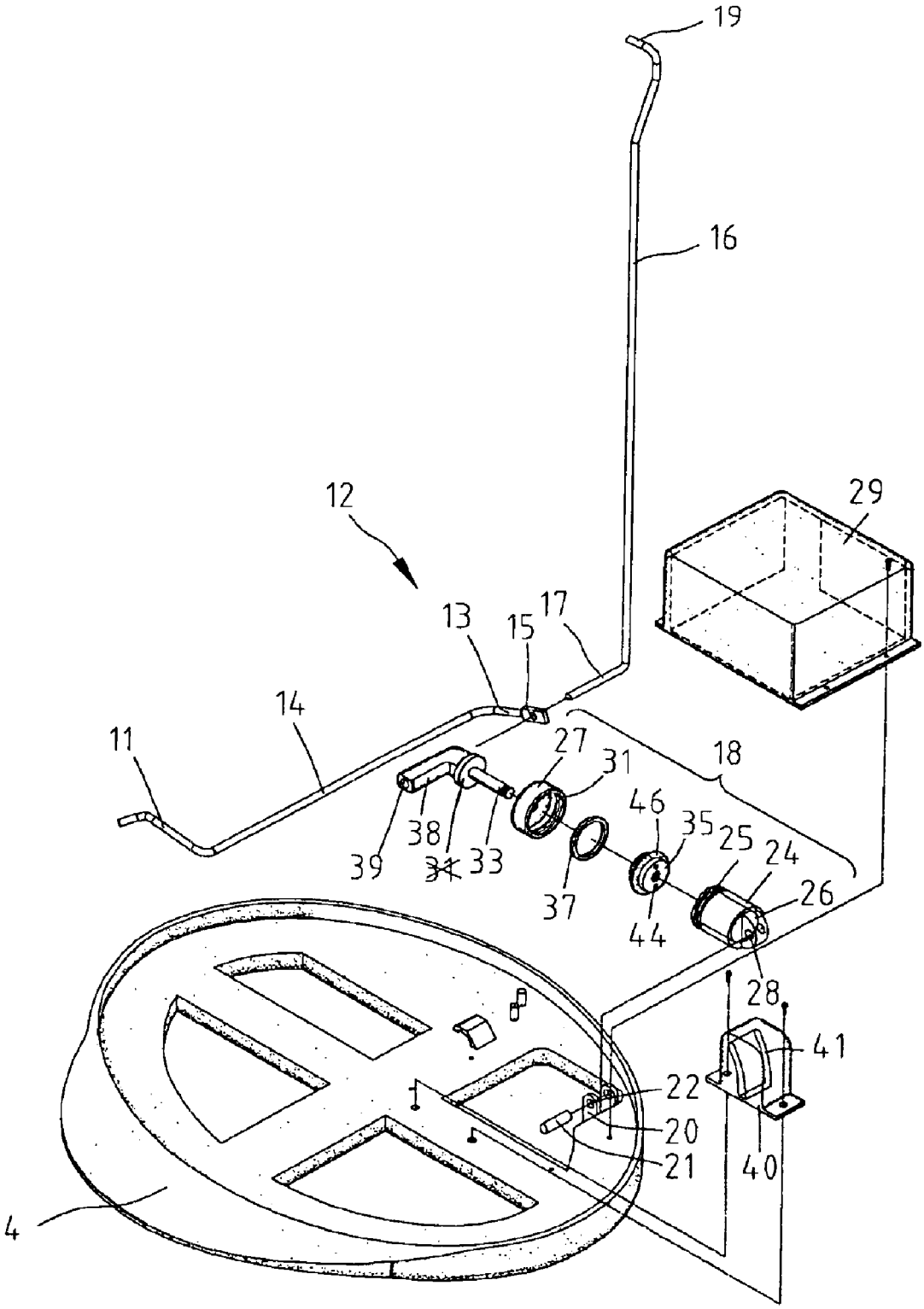
FIG. 10 is an exploded perspective view of a buffer used in a garbage storage device according to a second embodiment of the present invention.
Figure 11:
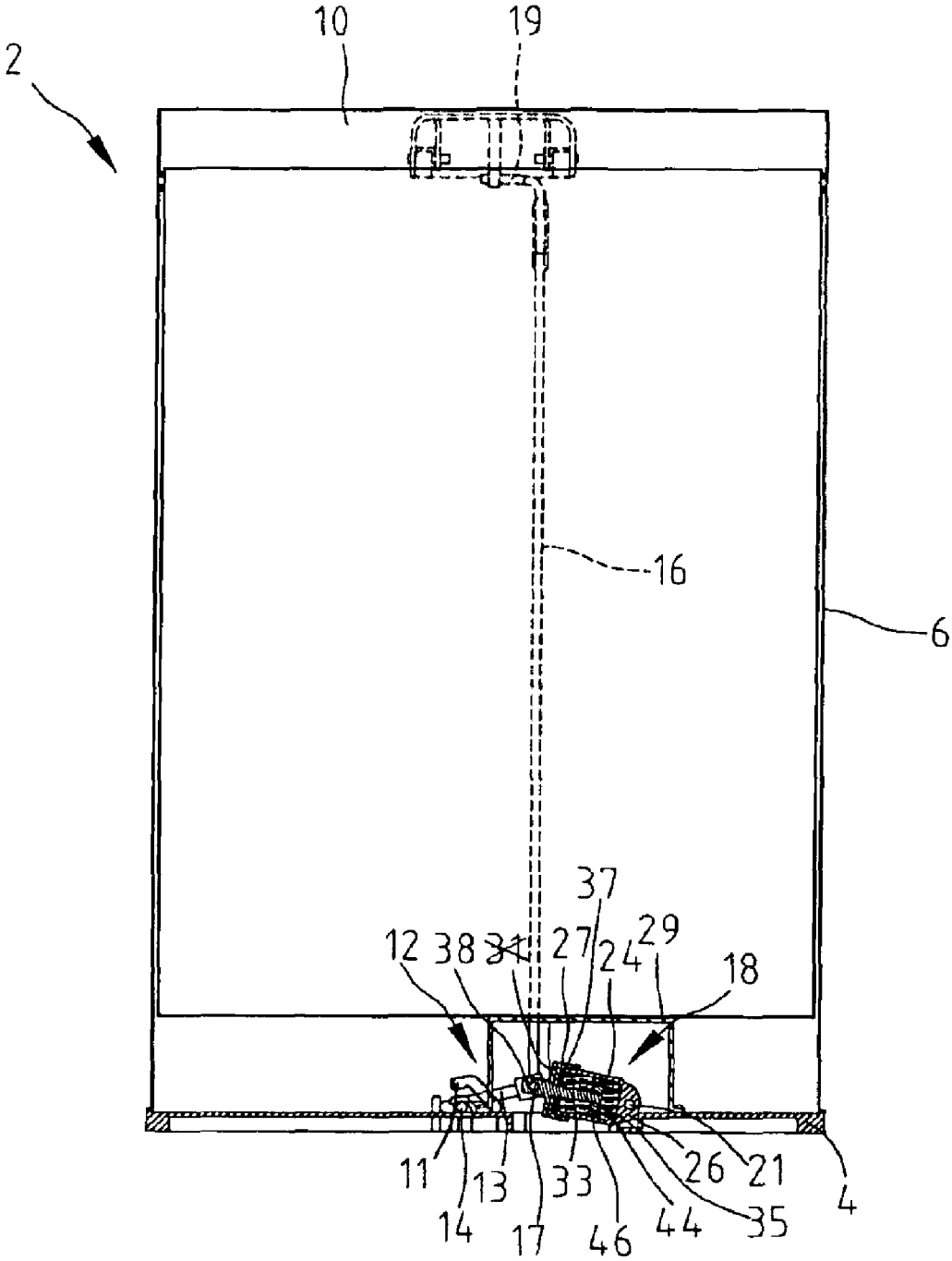
FIG. 11 is a cross-sectional view of the garbage storage device shown in FIG. 10, showing the buffer in a first position.
Figure 12:
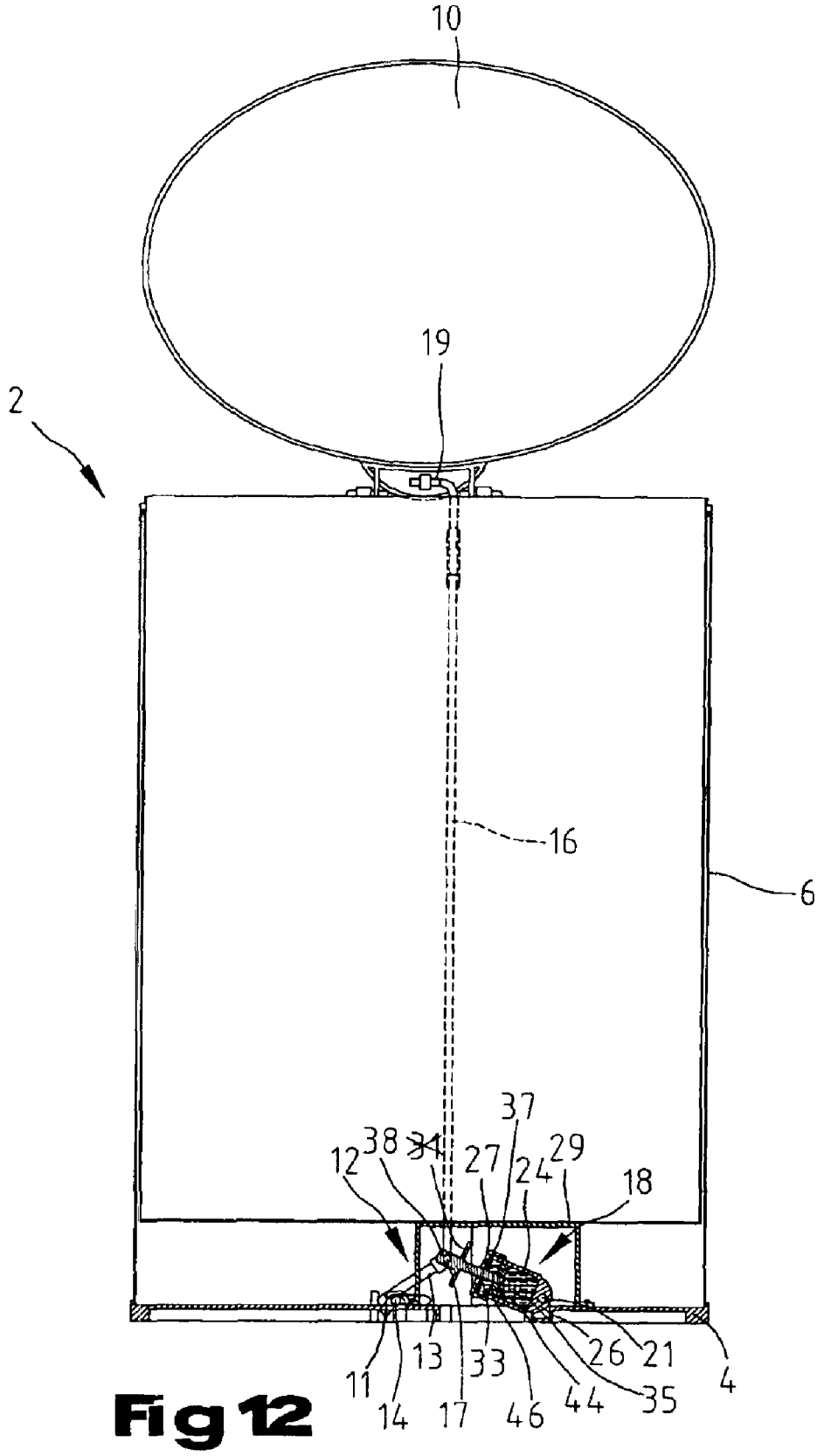
FIG. 12 is a cross-sectional view of the garbage storage device shown in FIG. 10, showing the buffer in a second position.
Figure 13:
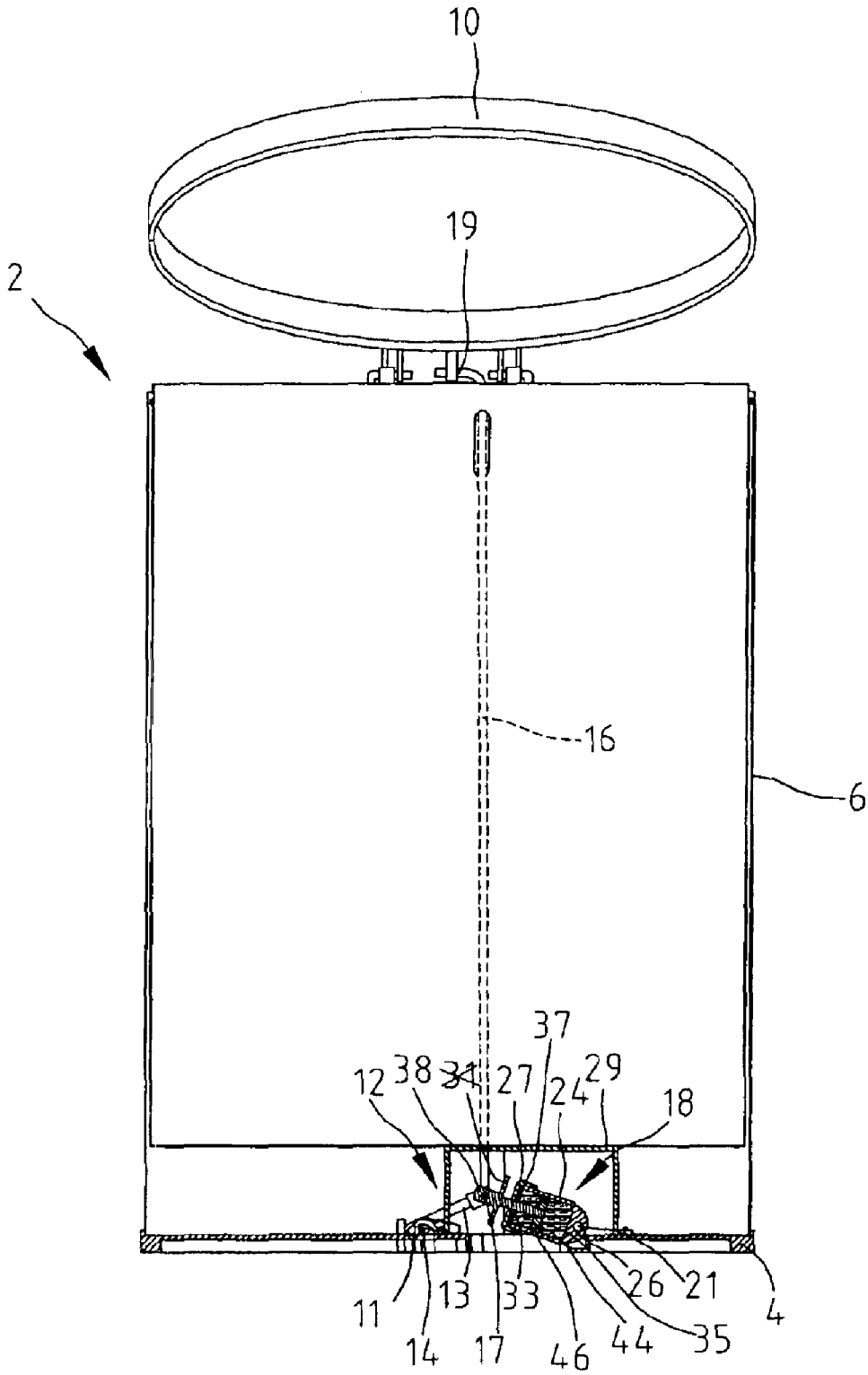
FIG. 13 is a cross-sectional view of the garbage storage device shown in FIG. 10, showing the buffer in a third position between the first and second positions.

Referring to FIGS. 8 and 9, the lid 10 is released. The lid 10 falls due to its weight. The movement of the lid 10 is buffered or hindered via the buffer 18 since they are both connected with the linkage 12.

FIGS. 10~13 show a buffer 18 according to a second embodiment of the present invention. In the second embodiment, a connecting rod 33 and a piston 35 are used instead of the second cylinder 36, and oil instead of the spring 34. The piston 35 is secured to the connecting rod 33. The piston 35 defines two holes 44. A ring 46 is mounted on the piston 35. The oil is filled in the cylinder 24. A seal 37 is provided between the cylinder 24 and the ring 27 for retaining the oil in the cylinder 24.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A garbage storage device including:

a base;

a bin installed on the base;

a pedal mounted on the bin;

a lid mounted on the bin;

a linkage including a crankshaft and a rod, the crankshaft including a shaft rotatably mounted on the base a first crank extending from the shaft for contact with the pedal and a second crank extending from the shaft, the rod including a middle portion, a first end extending from the middle portion into a connection with the second crank and a second end extending from the middle portion into connection with the lid, with the connection of the rod first end with the second crank moving in a curved trajectory;

a buffer including a first end connected with the base and a second end connected with the first end of the rod, with spacing between the first and second ends of the buffer changing with movement of the connection of the rod first end with the second crank in the curved trajectory; and a guide mounted on the base, with the first end of the rod sliding along and being guided by the guide while moving in the curved trajectory and ensuring smooth movement of the first end of the rod in the curved trajectory.

2. The garbage storage device according to claim 1 wherein the guide defines a slot for receiving the first end of the rod.

3. The garbage storage device according to claim 1 wherein the second crank defines a hole through which the first end of the rod extends.

4. The garbage storage device according to claim 1 wherein the second end of the buffer defines a hole through which the first end of the rod extends.

5. The garbage storage device according to claim 1 wherein the buffer includes a spring connected between the base and the first end of the rod.

6. The garbage storage device according to claim 5 wherein the buffer includes a first cylinder including a closed end connected with the base and an open end through which the spring extends and a second cylinder including an open end through which the spring extends and a closed end connected with the first end of the rod.

7. The garbage storage device according to claim 6 wherein one of the first and second cylinders is partially inserted in the other one of the first and second cylinders.

8. The garbage storage device according to claim 7 wherein the second cylinder is partially inserted in the first cylinder.

9. The garbage storage device according to claim 8 wherein the buffer includes a ring mounted on the second cylinder.

10. The garbage storage device according to claim 9 wherein the buffer includes a groove around the second cylinder for receiving the ring.

11. The garbage storage device according to claim 6 wherein the base includes two ears formed thereon, and the first cylinder includes an ear formed at the closed end and mounted on the ears of the base.

12. The garbage storage device according to claim 11 including a pin fit in a hole defined in each of the ears and a hole defined in the ear of the first cylinder.

13. The garbage storage device according to claim 6 wherein the second cylinder includes a tube transversely extending from the closed end for receiving the first end of the rod.

14. The garbage storage device according to claim 1 wherein the buffer includes:

a cylinder including a closed end connected with the base and an open end; oil filled in the cylinder;

a piston sliding in the cylinder and defining at least one hole through which the oil can flow slowly; and a connecting rod including a first end connected with the piston and a second end connected with the first end of the rod.

15. The garbage storage device according to claim 14 including a ring engaged with the cylinder, thus retaining the piston in the cylinder.

16. The garbage storage device according to claim 15 including a seal installed between the ring and the cylinder.

17. The garbage storage device according to claim 14 including a ring mounted on the piston.

18. The garbage storage device according to claim 14 wherein the base includes two ears formed thereon, and the cylinder includes an ear formed at the closed end and mounted on the ears of the base.

19. The garbage storage device according to claim 14 including a pin fit in a hole defined in each of the ears and a hole defined in the ear of the first cylinder.

20. The garbage storage device according to claim 14 including a tube extending from the connecting rod for receiving the first end of the rod.

* * * * *